US005572830A

United States Patent [19]

Freeman

[11] Patent Number: 5,572,830

[45] Date of Patent: Nov. 12, 1996

[54] FOOT-OPERATED, WINDOW-RAISING DEVICE FOR A WINDOW HAVING A SLIDING SASH AND METHOD

[76] Inventor: Arthur Freeman, 7914 Ivy La., Elkins Park, Pa. 19117

[21] Appl. No.: 421,578

[22] Filed: Apr. 12, 1995

[51] Int. Cl.[6] ..... E05F 13/04

[52] U.S. Cl. ..... 49/273; 49/347

[58] Field of Search ..... 49/263, 273, 347, 49/506; 160/224

[56] References Cited

U.S. PATENT DOCUMENTS

| | | | |
|---|---|---|---|
| 14,851 | 5/1856 | Cole | 49/273 |
| 92,549 | 7/1869 | Stanfield | 49/349 |
| 297,720 | 4/1884 | Russell | 49/347 |
| 519,895 | 5/1894 | Sinks . | |
| 1,089,531 | 3/1914 | Carter . | |
| 1,206,340 | 11/1916 | Lawrence . | |
| 1,269,962 | 6/1918 | Sauermann | 49/273 |
| 1,305,614 | 6/1919 | Lindemann . | |
| 1,315,308 | 9/1919 | Homan . | |
| 1,412,871 | 4/1922 | Johnson | 49/273 X |
| 1,445,692 | 2/1923 | Johnson | 49/273 X |
| 1,497,821 | 6/1924 | Williams . | |
| 1,584,809 | 5/1926 | Rook . | |
| 1,596,961 | 8/1926 | Fulton . | |
| 2,187,561 | 1/1940 | Sampson | 49/347 X |
| 2,652,245 | 9/1953 | Bentley | 268/21 |
| 2,684,846 | 7/1954 | Beall | 268/58 |
| 2,917,791 | 12/1959 | Klein | 20/42 |

*Primary Examiner*—Kenneth J. Dorner
*Assistant Examiner*—Jerry Redman
*Attorney, Agent, or Firm*—Panitch Schwarze Jacobs & Nadel, P.C.

[57] ABSTRACT

A foot-operated, window-raising device for a window having a sliding sash, with the window being positioned a predetermined distance from a support surface. The foot-operated, window-raising device includes at least one pulley mounted to a frame member adjacent to the window and a moveable platform. A cord is threaded through the pulley and a first end is attached to the sliding sash. The cord is secured to the platform such that movement of the platform in a first direction causes the cord to open the sliding sash. The cord has a predetermined length which positions the platform between the window and the support surface at a height which is accessible by a user's foot. By stepping on the moveable platform, the platform moves in a first direction causing the cord to open the sliding sash.

14 Claims, 2 Drawing Sheets

FOOT-OPERATED, WINDOW-RAISING DEVICE FOR A WINDOW HAVING A SLIDING SASH AND METHOD

FIELD OF THE INVENTION

The present invention relates to a window-raising device, and more particularly, to a foot-operated window raising device for a window having a sliding sash.

BACKGROUND OF THE INVENTION

Double-hung windows with sliding sashes are commonly used in residential homes. The size of the window sashes are often large enough that the windows are difficult to open for children and people who have less strength or arthritis. Although the sliding sashes are sometimes counterbalanced with a system of pulleys and weights or springs located within the window frame to allow easier opening, there is still sometimes great resistance to opening due to warpage, paint build-up, etc. Even if a window is operating properly, no provisions are provided to allow an arthritic person with impaired dexterity to grasp the window.

In situations where it is imperative that a double-hung sliding sash window be opened by a child or a person with less strength or arthritis, such as during a house fire, an easy means for opening the window is required. One prior art system provided a pulley mounted above the lower sliding sash and a cord threaded through the pulley attached to the lower sliding sash at one end and having a handle on a second end. The user was required to grasp the handle end and pull down in order to raise the lower sliding sash.

Another prior art device for raising and lowering window sashes includes two cords attached to upper and lower window sashes in a double-hung window by a series of pulleys. A user could pull on the first cord to move both sashes into an open position, and pull on the second cord to move both sashes into a closed position.

The known prior art devices all require a user to grasp a cord and pull on it in order to open the sliding sash of a double-hung window. However, an arthritic or elderly person may lack the strength and dexterity to grasp a cord, and children often do not have enough hand and arm strength to pull on a cord to open a heavy window.

The present invention is a result of observation of the disadvantages inherent in the above-discussed window-raising devices, and the present inventor's recognition of the need for a window-raising device which can be easily operated by children, arthritic or elderly persons. The present invention overcomes the above-described disadvantages by providing a foot-operated, window-raising device for a window having a sliding sash. Generally, a person's leg strength is much greater than their arm strength. Additionally, applying a force through a foot operated device allows a person to utilize their body weight This allows children, arthritic or elderly persons to open a window more easily by taking advantage of their greater leg strength and the ability to apply their body weight through a foot-operated, window-raising device.

SUMMARY OF THE INVENTION

Briefly stated, the present invention is a foot-operated, window-raising device for a window having a sliding sash, with the window being positioned a predetermined distance from a support surface. The foot-operated, window-raising device comprises at least one pulley mounted to a frame member adjacent to the window and a moveable platform. A cord is threaded through the pulley and a first end is attached to the sliding sash. The cord is secured to the platform such that movement of the platform in a first direction causes the cord to open the sliding sash. The cord has a predetermined length which positions the platform between the window and the support surface at a height which is accessible by a user's foot.

The present invention also provides a method of opening a window having a sliding sash. The method includes stepping on a moveable platform which is connected to the sliding sash by at least one cord. The cord is threaded through a pulley attached to a window frame member. Movement of the platform in a first direction causes the cord to open the sliding sash.

BRIEF DESCRIPTION OF THE DRAWINGS

The foregoing summary, as well as the following detailed description of preferred embodiments of the invention, will be better understood when read in conjunction with the appended drawings. For the purpose of illustrating the invention, there is shown in the drawings embodiments which are presently preferred. It should be understood, however, that the invention is not limited to the precise arrangements and instrumentalities shown. In the drawings.

DETAILED DESCRIPTION OF PREFERRED EMBODIMENTS

Figure 1:
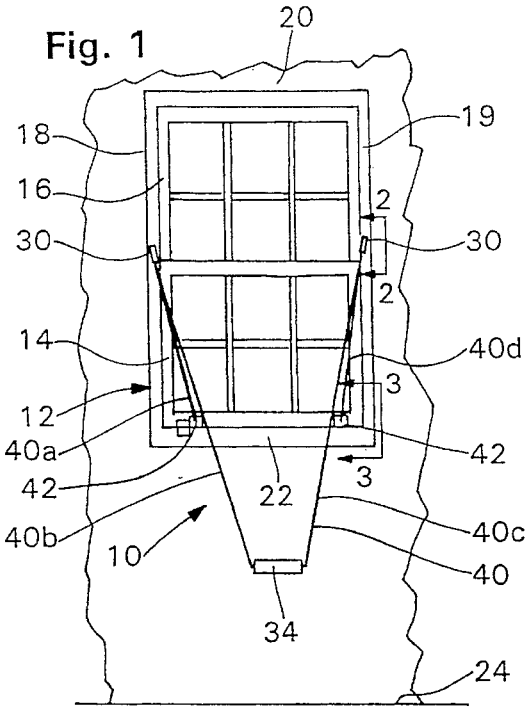
FIG. 1 is a front elevational view of a window having a sliding sash with a foot-operated, window-raising device in accordance with the present invention.

Certain terminology is used in the following description for convenience only and is not limiting. The words "right," "left," "lower" and "upper" designate directions in the drawings to which reference is made. The words "inwardly" and "outwardly" refer to directions toward and away from, respectively, the geometric center of the foot operated window raising device and designated parts thereof. The terminology includes the words above specifically mentioned, derivatives thereof and words of similar import.

Referring to the drawings, wherein like numerals indicate like elements throughout, there is shown in FIGS. 1–4, a first embodiment of a foot-operated, window-raising device, generally designated as 10, for a window 12 having a sliding sash 14, in accordance invention. The foot-operated, window-raising device 10 is generally used with double-hung windows 12 having a lower sliding sash 14 and an upper sliding sash 16. The window 12 generally includes side frame members 18 and 19, and top and bottom frame members 20 and 22, respectively which support the sliding sashes 14 and 16, in a manner well understood by those skilled in the art. Typically, the window 12 is positioned a predetermined distance from a support surface, such as a floor 24, and the bottom window frame member 22 is generally located from approximately 24 to 42 inches above the support surface. However, it will be understood by those skilled in the art from the present disclosure that the window 12 may be of other types, such as horizontally sliding windows.

Figure 2:
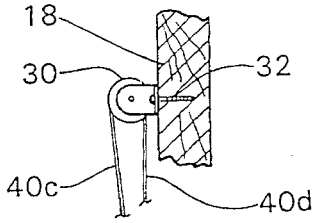
FIG. 2 is an enlarged section view taken along line 2—2 in FIG. 1.

Referring now to FIGS. 1 and 2, at least one pulley 30 is mounted to a side frame member 18 or 19 adjacent to the window 12. In the preferred embodiment, a pulley 30 is mounted to each side member 18 and 19 on opposite sides of the window 12. Preferably, the pulleys 30 are mounted to the side frame members 18 and 19 in a position above the lower sliding sash 14. However, it is understood by those skilled in the art from the present disclosure that the pulleys 30 can be mounted to the wall adjacent to the window 12 or in a position slightly below the upper sash for partial opening.

In the preferred embodiment, the pulleys 30 are mounted to the frame members 18 with wood screws or lag bolts 32. The pulley 30 is a fixed-mounted pulley. However, it is understood by those skilled in the art from the present disclosure that a pivotally-mounted pulley 30 can be utilized if desired. Additionally, depending upon the particular application, the pulley may be replaced with an eye bolt or a similar device having a smooth surface over which a cord or rope can slide freely.

Referring now to FIG. 1, the foot-operated, window-raising device 10 includes a moveable platform 34. Preferably, the platform 34 is a tube of sufficient size to enable a user to place their foot thereon. In the preferred embodiment, the platform 34 is a piece of PVC pipe approximately 4"–6" long. However, it is understood by those skilled in the art from the present disclosure that the platform 34 may be made of other materials such as wood or metal and may take various forms such as a plate or a rectangular tube. The platform may also be mounted for linear vertical movement on an linear slide device (not shown) mounted below the window 12. As will be appreciated by those skilled in the art from the present disclosure, the type of platform 34 utilized in accordance with the present invention may be varied, and the disclosed preferred embodiment is not considered limiting.

Referring now to FIGS. 1–3, a cord 40 is threaded through the pulley 30 on one side of the window 12. The cord 40 has a first end portion which is attached to the lower sliding sash 14 and a middle portion of the cord 40 is secured to the platform 34. Specifically, a first end of the cord 40 is attached to a lower left corner of the lower sliding sash 14, and a first portion **40*a* of the cord 40 extends up to and is threaded through the first pulley 30, mounted to the frame member 18 on the left side of the window 12. A second portion 40*b* of the cord 40 descends toward the platform 34 and is threaded through the tubular platform 34. A third portion 40*c* of the cord 40 extends up from the platform 34 toward the second pulley 30, mounted on the frame member 19 on the right side of the window 12. The cord 40 is threaded through the second pulley 30, and a fourth portion 40*d* of the cord 40 extends down toward the 10 lower sliding sash 14, where it terminates at the second end of the cord 40, which is attached to the lower right corner of the lower sliding sash 14. Because the platform 34 is a tube, it is self-centering on the second and third portions 40*c* and 40*d* of the cord 40**.

In the preferred embodiment, the cord 40 has a predetermined length which positions the platform 34 between the window 12 and the support surface 24 at a height which is accessible by a user's foot. Preferably, the cord is made of a braided nylon material. However, it is understood by those skilled in the art from the present disclosure that the cord 40 may be made of other materials, such as hemp, braided metal wire, or other suitable synthetic materials, and the length of the cord 40 will be varied depending upon the particular application. Additionally, depending upon the particular application, two separate cords (not shown) can be used with the first cord being equivalent to portions **40*a* and 40*b* and the second cord being equivalent to portions 40*c* and 40*d* of the illustrated cord 40. When two separate cords are used, they are attached to opposite ends of the platform 40**.

Figure 3B:
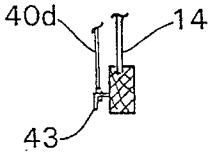
FIG. 3*b* is an enlarged section view taken along line 3—3 in FIG. 1 of an alternate attachment.
Figure 3A:
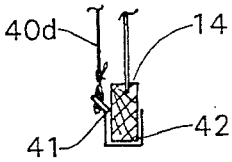
FIG. 3*a* is an enlarged section view taken along line 3—3 in FIG. 1.

Referring now to FIG. **3*a*, the first and second end portions 40*a* and 40*d* of the cord 40 are attached to the sliding sash using a non-maring, U-shaped bracket 42 which is removably attached to the bottom edge of the lower sliding sash 14. Preferably, the bracket 42 is made from bent-up sheet metal, such as aluminum or steel, and includes 10 an aperture 41 for securing the first and second ends 40*a* and 40*d* of the cord 40. However, it is understood by those skilled in the art from the present disclosure that the cord may be attached to the sliding sash by other means such as screw hooks 43 (as shown in FIG. 3*b***), eye bolts, screws, nails, or any other suitable attachment means, depending upon the particular application.

Having described the structure of the first embodiment of the foot-operated, window-raising device 10 in accordance with the present invention, a brief description of its installation and operation follow with respect to FIGS. 1–4. Preferably, the foot-operated, window-raising device 10 is installed by mounting at least one pulley 30 to the frame member 18 or 19 adjacent to the window 12. Preferably, a pulley 30 is mounted to each side frame member 18 and 19 of the window 12. After the pulleys 30 are mounted, the cord 40 is threaded through at least one pulley 30. The first end portion **40*a* of the cord 40 is attached to the lower sliding sash 14. Preferably, the U-shaped bracket 42 is placed over the lower edge of the lower sliding sash 14 and the first end 40*a* is secured to the aperture 41 in the bracket 42. The length of the cord 40 is then adjusted and the cord 40 is secured to or threaded through the platform 34, which is positioned between the window 12 and the support surface 24 at a height which is accessible a user's foot. The remaining portion 40*c* and 40*d* of the cord 40 is then threaded through the opposite pulley 30, and the second end portion 40*d* of the cord 40 is trimmed to a desired length such that the platform is suspended a sufficient distance above the floor so that the lower sliding sash 14 will open (i.e. the platform 34 must be at least the same or a greater distance from the floor as the desired window opening distance between the bottom of the lower sliding sash 14 and the sill then the lower sliding sash 14 is in the open position). The cord 40 is then secured to the lower edge of the lower sliding sash 14 using a U-shaped bracket 42. The platform 34 is self-centered by gravity on the two middle portions 40*c* and 40*d* of the cord 40**.

Figure 4:
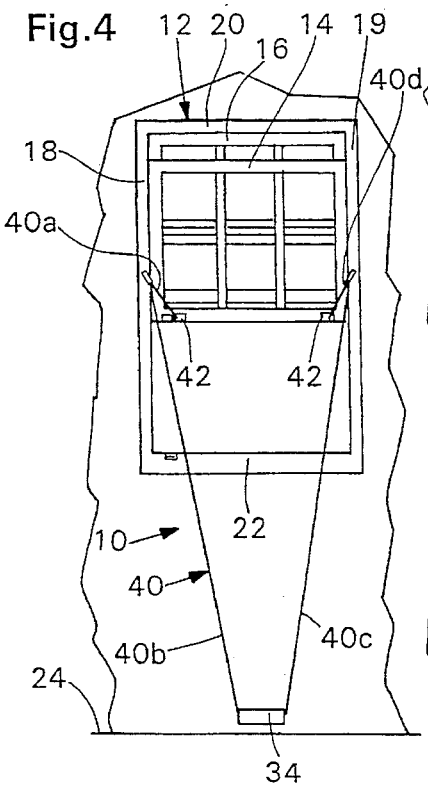
FIG. 4 is a front elevational view, similar to FIG. 1, showing the foot-operated, window-raising device of FIG. 1 with the sliding sash in the open position.

In operation, the lower sliding sash 14 of the window 12, which starts in the position shown in FIG. 1, is opened by a user stepping on the moveable platform 34 which is connected to the sliding sash 14 by at least one cord 40, with the cord 40 being threaded through pulley(s) 30 attached to the window frame(s)18 and 19. The platform 34 moves in a first direction (i.e. downwardly) in response to the force applied by the user's foot, causing cord 40 to open the lower sliding sash 14 as the platform 34 descends to a lower position, as shown in FIG. 4.

In applications where toddlers and small children are present, it is preferable to store the platform 34 out of reach, such as on the sill of the window, with the excess cord 40 draped over the pulleys. Alternatively, a system having a single pulley with the platform 34 mounted on a vertically oriented linear slide affixed to the wall can be used so that no loose cords are present.

Figure 5:
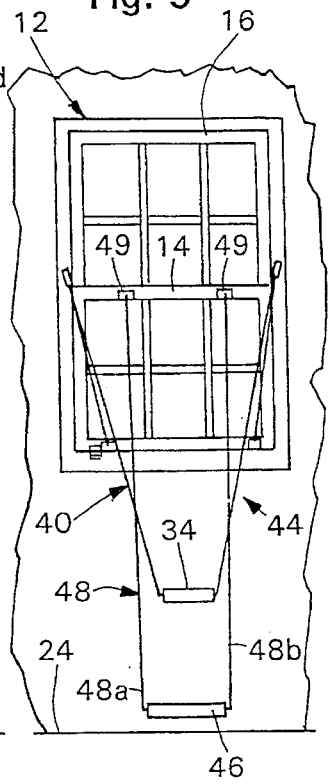
FIG. 5 is a front elevational view of a second embodiment of the foot-operated, window-raising device for a window having a sliding sash in accordance with the present invention.
Figure 6:
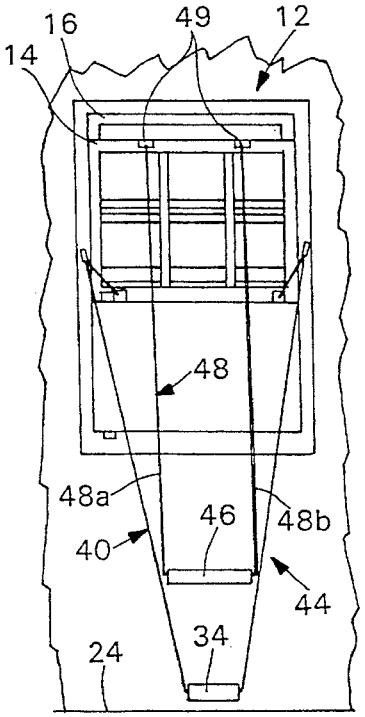
FIG. 6 is a front elevational view similar to FIG. 5 showing the foot-operated, window-raising device of FIG. 5 with the sliding sash in an open position.

A second embodiment of the foot-operated, window-raising device 44 is shown in FIGS. 5 and 6. The second embodiment of the foot-operated, window-raising device 44 is identical to the first embodiment 10 and also includes a second platform 46. Preferably, the second platform 46 is also a piece of PVC tubing. However, it is recognized by those skilled in the art from the present disclosure that the second platform may be a plate or a rectangular tube, and may be made of any suitable material, such as wood or metal.

A second cord 48 is attached between the lower sliding sash 14 and the second platform 46. A first end of the first portion of the cord 48*a* has a first end which is attached to the top edge of the lower sliding sash 14 by a bracket 49, which is similar to the U-shaped bracket 42 (shown in FIG. 3*a*) or may be attached with a screw hook 43 (as shown in FIG. 3*b*) or other fasteners as described above. The first portion of the cord 48*a* is then threaded through the tubular platform 46. The second portion of the cord 48*b* includes a second end which is attached to a second U-shaped bracket 49 which is also secured to the top edge of the lower sliding sash 14. The second cord 48 has a predetermined length which positions the second platform 46 between the window 12 and the support surface 24 at a height which is accessible by a user's foot when the lower sliding sash 14 is in an open position, such as shown in FIG. 6. When the lower sliding sash 14 is in the closed position, shown in FIG. 5, the length of the cord 48 is adjusted such that the second platform 46 is adjacent to the support surface 24.

In operation, a user steps on the second platform 46 when it is in the "up position" as shown in FIG. 6 to close the lower sliding sash 14.

Figure 7:
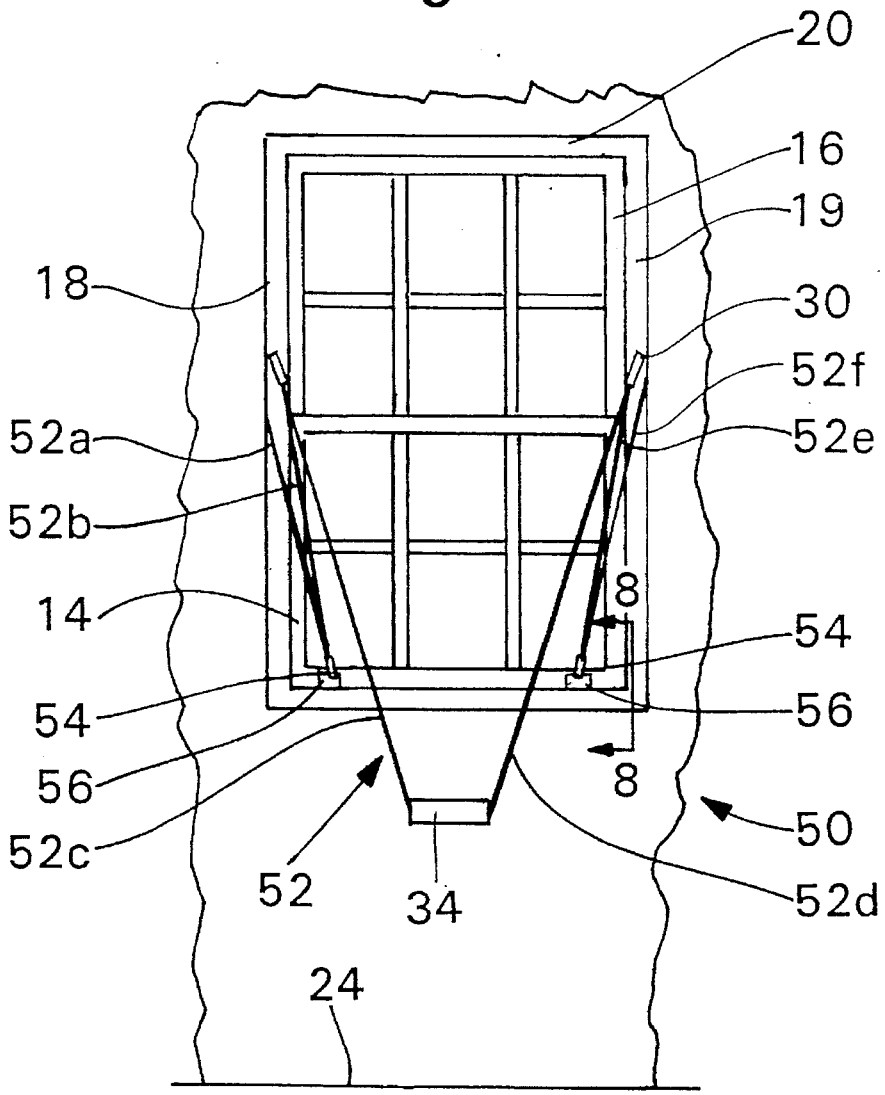
FIG. 7 is a front elevational view of a third embodiment of the foot-operated, window-raising device of the present invention.
Figure 8:
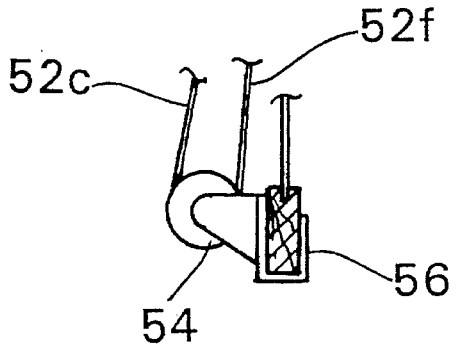
FIG. 8 is an enlarged section view taken along 8—8 in FIG. 7.

A third embodiment of the foot-operated, window-raising device 50 is shown in FIGS. 7 and 8. The third embodiment of the foot-operated, window-raising device 50 includes two pulleys 30 mounted to the side frame members 18 and 19 adjacent to the window 12, in a similar fashion to the first and second embodiments. A sash pulley 54 is attached to the lower edge of the lower sliding sash 14. Preferably, two sash pulleys 54 are attached to the lower sliding sash 14 with U-shaped brackets 56, as shown in detail in FIG. 8. Preferably, the U-shaped brackets 56 are made of bent-up sheet metal. However, it is understood by those skilled in the art from the present disclosure that other materials such as a polymeric material could be used if desired. Additionally, it is similarly understood that the pulleys 54 may be attached to the lower sliding sash 14 directly with fasteners such as wood screws or lag bolts (not shown).

The moveable platform 34 is suspended by a cord 52 having a first end which is affixed to an eye bolt (not shown) installed in the side frame member 18 adjacent to the window 12 . The second end of the cord 52 is then threaded through the second pulley 54 affixed to the lower sliding sash 14 and the first pulley 30 mounted to the side frame member 18, respectively, prior to being secured to the platform 34. In the preferred embodiment, two pulleys 30 are mounted to the side frame members 18 and 19, and to the sash pulleys 54 are secured to the lower sliding sash 14. The cord 52 has a first end which is secured to the side frame member 18 with an eye bolt (not shown) on the left side of the window 12, and a first portion 52*a* of the cord 52 descends down to and is threaded through the sash pulley 54 located on the left side of the lower sliding sash 14 and a second portion 52*b* of the cord 52 extends up to and is threaded through the pulley 30 mounted on the left-side frame member 18. A third portion 52*c* of the cord 52 descends to the tubular platform 34 and is preferably threaded therethrough. A fourth portion 52*d* of the cord 52 extends up from the platform 34 to the pulley 30 mounted on the right-side frame member 19 of the window 12. The cord 52 is threaded through the pulley 30 and a fifth portion of the cord 52*e* descends to and is threaded through the second sash pulley 54 affixed to the lower edge on the left side of the lower sliding sash 14. The sixth portion 52*e* of the cord 52 extends up to and terminates at the second end of the cord 52, which is affixed to an eye bolt (not shown) installed in the right-side window frame member 19 in a position adjacent to the pulley 30, above the lower sliding sash 14. Because the lower platform 34 is tubular, it is self-centering on the cord 52.

In the preferred embodiment, the cord 52 has a predetermined length which positions the platform 34 between the window 12 and the support surface 24 at a height which is accessible by a user's foot. The cord 52 is preferably made of a braided nylon material, however it is similarly understood by those skilled in the art from the present disclosure that other materials such as hemp, braided metal wire or other synthetic filaments could be used. Additionally, it is similarly understood that the cord 52 could be broken into two separate cords if desired, with the first cord including portions 52*a*, 52*b* and 52*c* and the second cord including 52*d*, 52*e* and 52*f*, as described above in connection with the first embodiment.

The operation of the third embodiment of the foot operated window raising device 50 is the same as the first embodiment 10. Namely, a user steps on the moveable platform 34 which is connected to the sliding sash 14 by at least one cord 52, with the cord 52 being threaded through pulley(s) 30 attached to the window frame(s) 18 and 19 and sash pulleys 54 attached to the lower sliding sash 14. The platform 34 moves in a first direction in response to the force applied by the user's foot, causing cord 52 to open the lower sliding sash 14 as the platform 34 descends to a lower position. However, unlike the first embodiment 10, movement of the platform 34 in a first direction by a user exerting a force on the platform 34 creates a sash opening force which is twice as great as the force applied to the platform 34 to open the lower sliding sash 14. This is particularly advantageous for heavy or hard to open windows.

Although the presently preferred embodiments have been described in terms of a double-hung window having a sliding sash, it can also be utilized with horizontally sliding window sashes by using a system with a pulley and a cord to translate the vertical movement of a person's foot on a platform to horizontal movement for opening the horizontally sliding sash.

It will be appreciated by those skilled in the art that changes could be made to the embodiments described above without departing from the broad inventive concept thereof. It is understood, therefore, that this invention is not limited to the particular embodiments disclosed, but it is intended to cover modifications within the spirit and scope of the present invention as defined by the appended claims.

I claim:

1. A foot operated window raising device in combination with a window having a sliding sash, the window being positioned a distance from a support surface, the device comprising:

at least one pulley mounted to a frame member adjacent to the window;

a moveable platform; and a cord, threaded through the pulley, having a first end which is attached to the sliding sash at a point lower than the pulley, the cord is secured to and supports the platform such that movement of the platform in a first direction causes the cord to open the sliding sash, the cord having a length which positions the platform between the window and the support surface at a height which is accessible by a user's foot.

2. The device of claim 1 wherein the pulley is mounted to the frame member in a position above the sliding sash.

3. The device of claim 1 wherein there are two pulleys, each mounted to a frame member on opposite sides of the window, and wherein there are two cords, each cord having a first end and a second end, each cord being threaded through a respective pulley with the first end of each cord being attached to the sliding sash, and the second end of each cord being attached to the moveable platform.

4. The device of claim 1 wherein the platform is a tube, and wherein the cord has a second end, the second end of the cord being threaded through the tube and a second pulley, the second pulley being attached to a frame member adjacent to the window, the second end of the cord being attached to the sliding sash.

5. The device of claim 1 wherein the platform is mounted for linear movement.

6. The device of claim 1 wherein the sash has a bottom edge and wherein a non-maring, U-shaped clamp is removably attached to the bottom edge of the sliding sash to attach the first end of the cord to the sliding sash.

7. The device of claim 1 further comprising:

a second platform;

a second cord attached between the sliding sash and the second platform, the second cord having a predetermined length which positions the second platform between the window and the support surface at a height which is accessible by a user's foot when the sliding sash is in an open position.

8. A foot operated window raising device in combination with a window having a sliding sash, the window being positioned a distance from a support surface, the device comprising:

at least one pulley mounted to a frame member adjacent to the window;

a second pulley attached to the sliding sash;

a moveable platform; and a cord having a first end which is affixed to a frame member adjacent to the window, the cord having a second end threaded through the second pulley affixed to the sliding sash, threaded through the first pulley and being secured to the platform such that movement of the platform in a first direction by a user exerting a force on the platform creates a sash opening force on the sliding sash through the second pulley which is twice as great as the force on the platform to open the sliding sash, the cord having a length which positions the platform between the window and the support surface at a height which is accessible by a user's foot.

9. The device of claim 8 wherein the pulley mounted to a frame member is mounted to the frame member in a position above the sliding sash.

10. The device of claim 8 wherein the platform is mounted for linear movement.

11. A foot operated window raising device in combination with a window having a sliding sash, the window being positioned a distance from a support surface, the device comprising:

a first pulley mounted to a frame member adjacent to a first side of the window and a second pulley mounted to a frame member adjacent to a second side of the window, opposite to the first side;

a tube; and a cord, having a first end and a second end, the first end of the cord being attached to the sliding sash and the chord being threaded through the first pulley, the tube and the second pulley, respectively, the second end of the cord being attached to the sliding sash, the cord having a length to position the tube between the window and the support surface at a height that is accessible by a user's foot, such that movement of the tube in a first direction by the application of a user's foot causes the cord to open the sliding sash.

12. The device of claim 11 further comprising:

a second platform;

a second cord attached between the sliding sash and the second platform, the second cord having a predetermined length which positions the second platform between the window and the support surface at a height which is accessible by a user's foot when the sliding sash is in an open position.

13. A method of opening a window having a sliding sash comprising:

stepping on a moveable platform which is connected to the sliding sash by at least one cord, the cord being threaded through a pulley attached to a window frame member, and being attached to the sliding sash at a point lower than the pulley such that movement of the platform in a first direction causes the cord which supports the platform to open the sliding sash.

14. A method of installing the foot operated window raising device of claim 1 comprising the steps of:

(a) mounting at least one pulley to the frame member adjacent to the window;

(b) threading the cord through the pulley;

(c) attaching the first end of the cord to the sliding sash; and (d) adjusting the length of the cord and securing the cord to the platform such that the platform is positioned between the window and the support surface at a height which is accessible by the user's foot.

* * * * *